US006870509B2

(12) United States Patent
Ooe et al.

(10) Patent No.: US 6,870,509 B2
(45) Date of Patent: Mar. 22, 2005

(54) VEHICULAR ANTENNA DEVICE

(75) Inventors: Junzo Ooe, Aichi-ken (JP); Tetsuji Imoto, Kobe (JP)

(73) Assignees: Toyota Jidosha Kabushiki Kaisha, Toyota (JP); Fujitsu Ten Limited, Kobe (JP)

( * ) Notice: Subject to any disclaimer, the term of this patent is extended or adjusted under 35 U.S.C. 154(b) by 0 days.

(21) Appl. No.: 10/360,870

(22) Filed: Feb. 10, 2003

(65) Prior Publication Data

US 2003/0156070 A1 Aug. 21, 2003

(30) Foreign Application Priority Data

Feb. 21, 2002 (JP) ..... 2002-045019
Apr. 17, 2002 (JP) ..... 2002-115272

(51) Int. Cl.[7] ..... H01Q 1/32
(52) U.S. Cl. ..... 343/711; 343/713; 343/893
(58) Field of Search ..... 343/705, 711–713, 343/717–718, 841, 893, 824, 845–846, 850, 852–853, 860, 702, 700 MS

(56) References Cited

U.S. PATENT DOCUMENTS 4,200,874 A * 4/1980 Harada ..... 343/715
4,757,322 A * 7/1988 Yokogawa et al. ..... 343/712
4,788,549 A * 11/1988 Ohe et al. ..... 343/712
4,823,140 A * 4/1989 Shibata et al. ..... 343/713
5,177,495 A * 1/1993 Davies ..... 343/713
5,682,168 A * 10/1997 James et al. ..... 343/713
6,236,372 B1 5/2001 Lindenmeier et al. ..... 343/713
6,239,758 B1 5/2001 Fuchs et al. ..... 343/713
6,252,551 B1 * 6/2001 Noro et al. ..... 343/700 MS
6,448,935 B2 * 9/2002 Fuchs et al. ..... 343/713

FOREIGN PATENT DOCUMENTS

JP A 4-77005 3/1992
JP A 7-111412 4/1995

* cited by examiner

*Primary Examiner*—Thuy Vinh Tran
(74) *Attorney, Agent, or Firm*—Oliff & Berridge, PLC

(57) ABSTRACT

A plurality of glass antennas formed as patterns on quarter glass panes are provided in opposite sides of a rearward portion of a vehicle body. Branching filters connected to feeding points of the glass antennas via coaxial cables, phase-shift circuits for phase adjustment of the FM band outputs separated by the branching filters, and combining circuits for combining the FM band outputs that have been phase-adjusted by the phase-shift circuits are contained in a shield case that is grounded to the vehicle body. The outer conductors of the coaxial cables at the branching filter side are grounded to the shield case therein.

20 Claims, 9 Drawing Sheets

FIG. 2
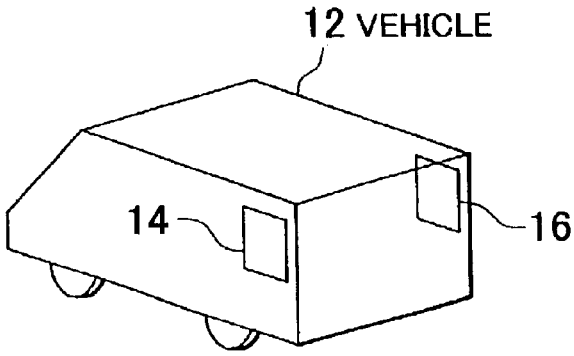
FIG. 3A
FIG. 3B
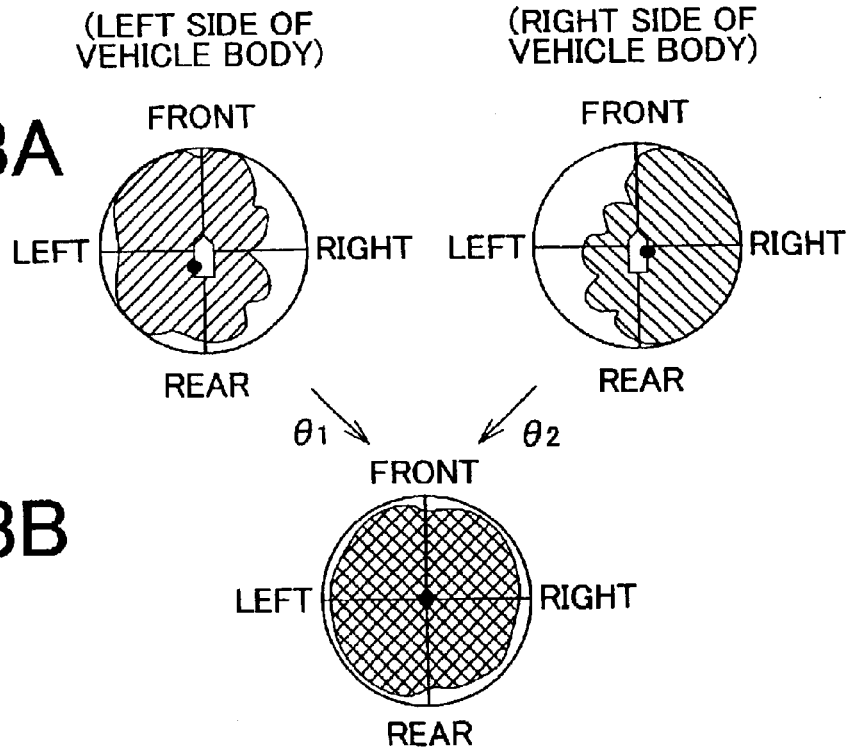

VEHICULAR ANTENNA DEVICE

INCORPORATION BY REFERENCE

The disclosure of Japanese Patent Applications No. 2002-115272 filed on Apr. 17, 2002 and No. 2002-045019 filed on Feb. 21, 2002 including the specifications, drawings and abstracts are incorporated herein by reference in their entirety.

BACKGROUND OF THE INVENTION

1. Field of the Invention

The invention relates to a vehicular antenna device and, more particularly, to a vehicular antenna device suitable for preventing noise intrusion and deterioration in reception sensitivity.

2. Description of the Related Art

There exists a vehicular antenna device having a plurality of antennas that are installed in a vehicle as disclosed in, for example, Japanese Patent Application Laid-Open Publication No. 4-77005. This device splits the outputs of the antennas into an AM band and an FM band. The device then combines signals of the AM band, and combines signals of the FM band after phase adjustment of the FM band signals. Therefore, the antenna device is able to secure sufficient AM-band reception sensitivity, and is also able to improve directivity while securing good FM-band reception sensitivity.

In the above-described antenna device, however, the combination of outputs of the antennas is performed at a site that is exposed outside and that is not grounded. Therefore, there is a danger of intrusion of noises from the site of signal combination. Furthermore, as the outer conductor of a coaxial cable connected to the site of signal combination functions as an antenna, there is a danger of leakage of output components from antennas, which may degrade the reception sensitivity, and may change the directivity.

SUMMARY OF THE INVENTION

Accordingly, it is an object of the invention to provide a vehicular antenna device capable of preventing noise intrusion and reception sensitivity deterioration and securing good reception performance by appropriately combining signals from a plurality of antennas.

The aforementioned object is achieved by a vehicular antenna device that includes a plurality of antennas provided on a vehicle, a combining circuit that outputs signals of the plurality of antennas, respectively, and at least one shield case grounded to a body of the vehicle. The combining circuit is contained in the at least one shield case.

In the invention, the combining circuit that combines output signals of the antennas is contained in the shield case grounded to the vehicle body. As the combining circuit is contained in the shield case and the shield case is grounded to the vehicle body, intrusion of noise into the combining circuit is substantially prevented, and leakage of antenna output is unlikely. Therefore, according to the invention, the combination of signals provided by the antennas is appropriately carried out, securing good reception performance.

In accordance with a preferred form of the invention, the above-described vehicular antenna device may further include a branching filter that splits output signals of each of the plurality of antennas. The combining circuit combines the split signals each having a predetermined frequency band, and the branching filter is contained in the shield case.

Further, in accordance with the preferred form of the invention, the vehicular antenna device may include a branching filter that splits output signals of each of the plurality of antennas, and a phase-shift circuit that performs phase adjustment of each of the split signals of a predetermined frequency band. The combining circuit combines signals each phase-adjusted by the phase-shift circuit and having the predetermined frequency band, and the branching filter and the phase-shift circuit are contained in the shield case.

In accordance with a preferred form of the invention, the vehicular antenna device may include a branching filter that splits output signals of the plurality of antennas into signals of a first frequency band and a second frequency band that is higher than the first frequency band, and a phase-shift circuit that performs phase adjustment of signals of the second frequency band split by the branching filter. The combining circuit includes a first combining circuit that combines signals of the first frequency band split by the branching filter, and a second combining circuit that combines signals of the second frequency band that are phase-adjusted by the phase-shift circuit, and the branching filter and the phase-shift circuit are contained in the shield case.

Furthermore, in the preferred form of the invention, the vehicular antenna device may include an output circuit that amplifies an output signal of the combining circuit, and outputs an amplified signal, wherein the output circuit is contained in the shield case.

In a structure in which an antenna is connected to an input side of the combining circuit, for example, the branching filter or the like provided at the input side of the combining circuit, via a coaxial cable, and a structure in which the aforementioned output circuit and a receiver that receives an output of the output circuit are connected via a coaxial cable, reception performance will be degraded if the outer conductor of the coaxial cable is grounded outside the shield case.

Therefore, if each of the plurality of antennas and an input side of the combining circuit are connected via a coaxial cable having an outer conductor grounded to the shield case therein, degradation in reception performance will be reliably prevented.

Furthermore, if the output circuit and a receiver that receives an output signal of the output circuit are connected via a coaxial cable having an outer conductor grounded to the shield case therein, degradation in reception performance will be reliably prevented.

In general, if a plurality of antennas have received frequency characteristics different from each other, widened-band reception can be realized by appropriately combining output signals of the antennas.

Therefore, if each of the plurality of antennas has a different received frequency characteristic, good reception performance can be secured in a broad band As the transmission path distance from an antenna to a shield case becomes longer, the transmission loss that occurs in the transmission of the antenna output to the shield case is increased, thus causing degradations in reception sensitivity.

Therefore, if the vehicular antenna device includes an amplifier circuit that is disposed near one of the plurality of antennas having at least a predetermined transmission path distance to the shield case, amplifies an output signal of the antenna, and outputs the amplified signal to the combining circuit, the antenna output is supplied to the combining circuit, with the transmission loss being offset by the amplifier circuit. The reception sensitivity degradation, thus, can be prevented, and good reception performance can be secured.

If the amplifier circuit is contained in another shield case separated from the shield case and grounded to the body of the vehicle, noise intrusion will be substantially prevented, and leakage of antenna output will become unlikely. Therefore, good reception performance will be secured.

In general, if an antenna is capable of receiving signals of different frequency bands and the output of the antenna is split into the different frequency bands through the use of a branching filter, there is a danger of loss of antenna output being caused by the branching filter. Such a loss degrades the reception sensitivity.

Therefore, in accordance with a preferred form of the vehicular antenna device of the invention, the antennas may include a plurality of first antennas of a first frequency band and a plurality of second antennas of a second frequency band, and the combining circuit includes a first combining circuit that combines output signals of the plurality of first antennas, and a second combining circuit that combines output signals of the plurality of second antennas.

Depending on the relationship between the received frequency band and the transmission distance from an antenna to a shield case, mismatch between the impedance at the side of the antenna and the impedance at the side of a cable connecting the antenna and the shield case becomes likely to occur, so that degradation in reception sensitivity may result.

Therefore, in accordance with a preferred form of the invention, the vehicular antenna device may further include an impedance matching circuit that is disposed near one of the plurality of antennas having at least a predetermined transmission path distance to the shield case, and that adjusts an impedance near the antenna and an impedance near the combining circuit on the transmission path.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein:

FIG. 2 is an external view of a vehicle in which the vehicular antenna device of the embodiment is installed;

FIGS. 3A and 3B are diagrams for illustrating a technique for improving the directivity of the vehicular antenna device of the embodiment with respect to the FM band;

DETAILED DESCRIPTION OF PREFERRED EMBODIMENTS

First Embodiment

Figure 1:
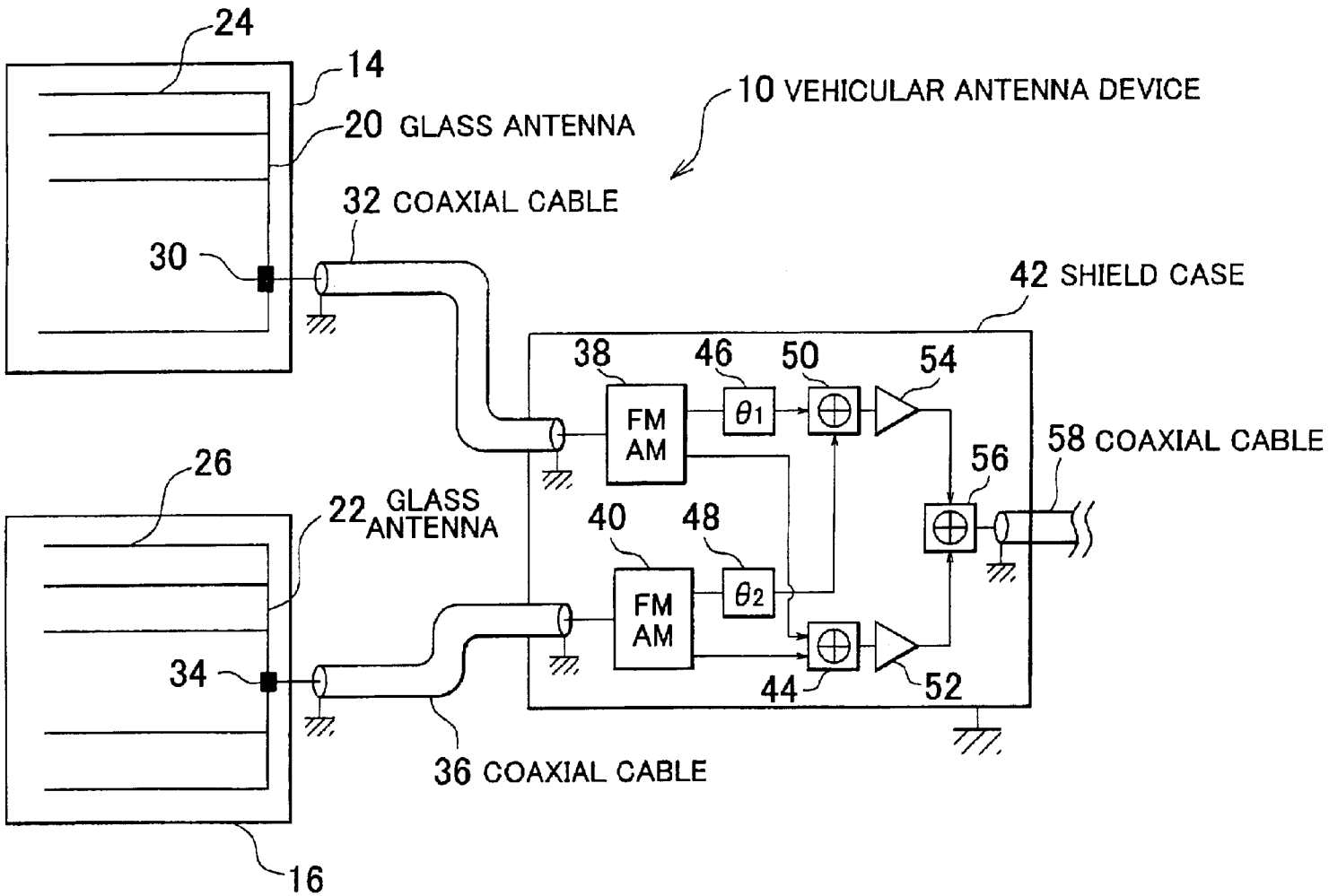
FIG. 1 is a diagram illustrating the structure of a vehicular antenna device in accordance with a first embodiment of the invention.

FIG. 1 is a diagram illustrating the structure of a vehicular antenna device 10 in accordance with a first embodiment of the invention. FIG. 2 is an external view of a vehicle 12 in which the vehicular antenna device 10 of the embodiment is installed. In this embodiment, the vehicle 12 has a width that is slightly less than 2 meters. As indicated in FIG. 2, the vehicle 12 has quarter glass panes 14, 16 that are provided in two opposite sides of a rearward portion of a vehicle body. That is, the two quarter glass panes 14, 16 are about 2 meters apart from each other.

As shown in FIG. 1, the vehicular antenna device 10 has a glass antenna 20 provided on the quarter glass pane 14, and a glass antenna 22 provided on the quarter glass pane 16. The glass antennas 20, 22 have antenna elements 24, 26 that are provided as patterns formed on the quarter glass panes 14, 16 by, for example, baking an electrically conductive paste on the glass panes.

The glass antennas 20, 22 are formed for reception of AM radio broadcasting in a medium frequency band, FM radio broadcasting and TV (VHF) broadcasting in a very high frequency band (specifically, 76 MHz to 222 MHz), and TV (UHF) broadcasting in a UHF band (specifically, 470 MHz to 770 MHz). The glass antenna 20 has a frequency characteristic of having a sensitivity peak in the band of FM radio broadcasting. The glass antenna 22 has a frequency characteristic of having a sensitivity peak in the band of TV (VHF) broadcasting. The two glass antennas 20, 22 have different frequency characteristics. Hereinafter, the band for AM radio broadcasting is simply termed AM band, and the band for FM radio broadcasting and the TV broadcasting is simply termed FM band.

A coaxial cable 32 is connected at an end thereof to a feeding point 30 of the glass antenna 20. A coaxial cable 36 is connected at an end thereof to a feeding point 34 of the glass antenna 22. The coaxial cables 32, 36, provided as antenna cables, transmit electric powers corresponding to the electromagnetic waves received by the glass antennas 20, 22. The outer conductor of the coaxial cable 32 at the side of the feeding point 30 is grounded to the body of the vehicle 12. The outer conductor of the coaxial cable 36 at the side of the feeding point 34 is also grounded to the body of the vehicle 12.

The other end of the coaxial cable 32 is connected to a branching filter 38. The other end of the coaxial cable 36 is connected to a branching filter 40. The branching filters 38, 40 are supplied with electric powers corresponding to the electromagnetic waves received by the glass antennas 20, 22. The branching filters 38, 40 perform functions of splitting the electromagnetic waves received by the glass antennas 20, 22 into different frequency bands of the AM and FM bands. The branching filters 38, 40 are both contained in a shield case 42 that is grounded to the body of the vehicle 12. The shield case 42 has a function of removing the influences of magnetic lines of force or electrostatic coupling from outside. The outer conductor of the coaxial cable 32 at the side of the branching filter 38 and the outer conductor of the coaxial cable 36 at the side of the branching filter 40 are grounded to the shield case 42 therein.

An AM band output of the branching filter 38 and an AM band output of the branching filter 40 are connected to a combining circuit 44. The combining circuit 44 is a circuit for in-phase combination of the AM band outputs of the branching filters 38, 40, that is, the AM band outputs provided by the glass antennas 20, 22. An FM band output of the branching filter 38 is connected to a phase-shift circuit 46. An FM band output of the branching filter 40 is connected to a phase-shift circuit 48. The phase-shift circuit 46 and the phase-shift circuit 48 perform phase adjustment of the FM band output produced by the branching filter 38 and the FM band output produced by the branching filter 40, respectively, as described below. An FM band output of the phase-shift circuit 46 and an FM band output of the phase-shift circuit 48 are connected to a combining circuit 50. The combining circuit 50 combines the FM band outputs of the phase-shift circuits 46, 48, that is, the FM band outputs provided by the glass antennas 20, 22. The combining circuits 44, 50 and the phase-shift circuits 46, 48 are all contained in the shield case 42.

An output of the combining circuit 44 is connected to an amplifier circuit 52. An output of the combining circuit 50 is connected to an amplifier circuit 54. The amplifier circuit 52 and the amplifier circuit 54 perform impedance conversion of the combined AM band output produced by the combining circuit 44 and the combined FM band output produced by the combining circuit 50, respectively, for the purpose of the matching of the outputs. An output of the amplifier circuit 52 and an output of the amplifier circuit 54 are connected to a mixer 56. The mixer 56 combines the outputs of the amplifier circuits 52, 54, that is, the AM band outputs and the FM band outputs provided by the glass antennas 20, 22. The amplifier circuits 52, 54 and the mixer 56 are all contained in the shield case 42.

An output of the mixer 56 is connected to an end of a coaxial cable 58. The coaxial cable 58 transmits a combined output produced by the mixer 56 from the AM band outputs and the FM band outputs provided by the glass antennas 20, 22. The outer conductor of the coaxial cable 58 at an end thereof is grounded to the shield case 42 therein. The other end of the coaxial cable 58 is connected to a receiver (not shown). The receiver is supplied with the combined output from the mixer 56. The receiver performs signal-processing of the combined output from the mixer 56 so that appropriate broadcasts of AM radio, FM radio, TV (VHF) and TV (UHF) are accomplished.

In general, the area of opening of an antenna pattern needs to be large for high-sensitivity reception of AM band electromagnetic waves. However, in some vehicles in which AM band electromagnetic waves are received by a glass antenna provided on a window glass pane, provision of a glass antenna on a large-area rear glass may be impossible due to vehicle structural constraints. Furthermore, if a glass antenna is provided on a single quarter glass pane provided at a side of a vehicle, it is difficult to achieve sufficiently high sensitivity due to a small area of the quarter glass pane.

In contrast, in the structure of the embodiment, AM band electromagnetic waves are received by the two glass antennas 20, 22, and the AM band electromagnetic waves received by the two glass antennas 20, 22 are combined in an in-phase manner. In the structure in which the AM band outputs provided by the two glass antennas 20, 22 are combined, the effective area of opening of pattern as the whole antenna is increased, so that the AM band reception sensitivity improves.

It is to be noted that the wavelength of electromagnetic waves in the AM band (e.g., about 400 m in the case of 750 kHz) is sufficiently longer than the distance between the quarter glass panes 14, 16 where the glass antennas 20, 22 are provided. Therefore, it is not necessary to consider the phase difference caused by different spatial distances of the two glass antennas 20, 22, in combining the AM band electromagnetic waves received by the antennas. In this respect, if the AM band electromagnetic waves received by the two glass antennas 20, 22 are in-phase combined as in this embodiment, deterioration in the AM band reception sensitivity caused by the phase difference between the AM band electromagnetic waves received by the two antennas is avoided. Therefore, according to the vehicular antenna device 10 of the embodiment, the AM band reception sensitivity will be improved.

Figure 4:
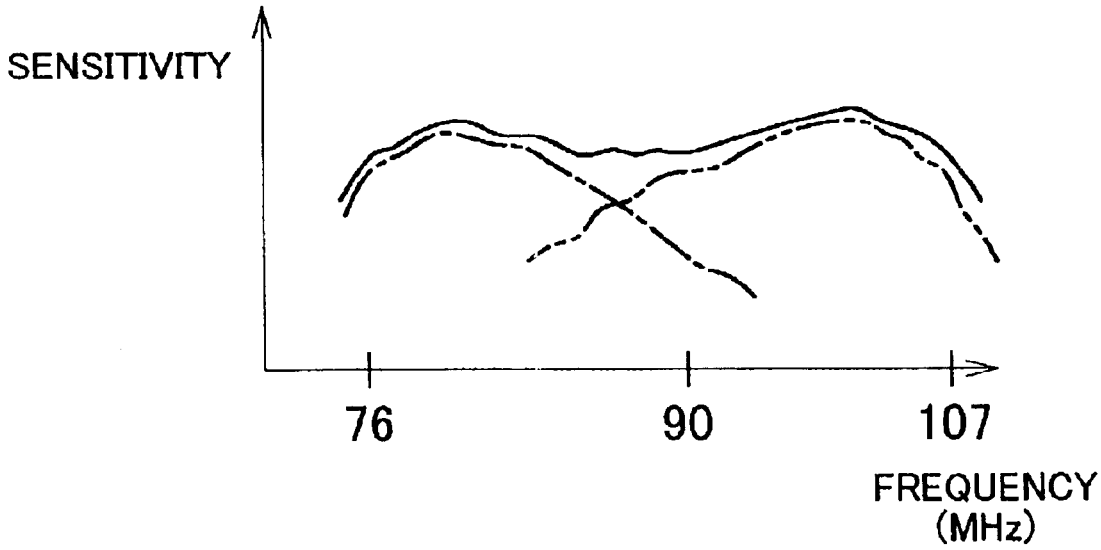
FIG. 4 is a diagram for illustrating a technique for realizing a widened band reception for the FM band in the vehicular antenna device of the embodiment.

FIGS. 3A and 3B are diagrams for illustrating a technique for improving the directivity of the vehicular antenna device 10 of the embodiment with respect to the FM band. FIG. 3A indicates the directivities of the glass antennas 20, 22, which receive FM band electromagnetic waves. FIG. 3B indicates an antenna directivity after the combination of the FM band electromagnetic waves received by the glass antennas 20, 22. FIG. 4 is a diagram for illustrating a technique for realizing a widened band reception for the FM band in the vehicular antenna device 10 of the embodiment. In FIG. 4, a frequency characteristic of the glass antenna 20 provided on a left-side surface of the vehicle body is indicated by a one-dot chain line, and a frequency characteristic of the glass antenna 22 provided on a right-side surface of the vehicle body is indicated by a two-dot chain line, and a frequency characteristic obtained after the combination of the electromagnetic waves of the two glass antennas 20, 22 in the embodiment is indicated by a solid line.

If the glass antennas 20, 22 are installed in the vehicle 12, the directivities of the glass antennas 20, 22 with respect to the FM band become as indicated in FIG. 3A, due to the presence of the vehicle body. That is, sensitivity is high at an outer side of the vehicle body whereas sensitivity is low at an inner side of the vehicle body. In order to offset the sensitivity reductions, it is necessary to appropriately combine the FM band electromagnetic waves received by the two glass antennas 20, 22.

Since the wavelength of electromagnetic waves of the FM band (e.g., about 4 m in the case of 76 MHz) is about twice the distance between the quarter glass panes 14, 16 (about 2 m), the phase difference caused by the different special distances of the two glass antennas needs to be considered in order to appropriately combine the FM band electromagnetic waves received by the two glass antennas 20, 22. That is, if FM band electromagnetic waves propagate to the vehicle 12 in a direction of the vehicle width, the electromagnetic waves received by the two glass antennas 20, 22 are substantially opposite in phase to each other. Therefore, if the received FM band electromagnetic waves are simply combined in an in-phase manner or an opposite-phase manner, the FM band reception sensitivity may drop due to the phase difference between the electromagnetic waves received by the two antennas, so that high directivity cannot be secured.

Furthermore, if the distance between the glass antenna 20 and the branching filter 38 is different from the distance between the glass antenna 22 and the branching filter 40, that is, if the coaxial cable 32 differs in length from the coaxial cable 36, the signals input to the branching filters 38, 40 have a phase difference corresponding to the cable length difference. Therefore, if such a phase difference is not considered, the FM band reception sensitivity may deteriorate in some cases.

As mentioned above, the two glass antennas 20, 22 have different frequency characteristics. Specifically, as can be understood from the frequency characteristic of the glass antenna 20 indicated by the one-dot chain line and the frequency characteristic of the glass antenna 22 indicated by the two-dot chain line in FIG. 4, the glass antenna 20 has a sensitivity peak in a relatively low frequency range in the FM band, and the glass antenna 22 has a sensitivity peak in a relatively high frequency range in the FM band.

In this embodiment, therefore, the phase-shift circuit 46 shifts the phase of the FM band output of the branching filter 38 by an angle θ1, and the phase-shift circuit 48 shifts the phase of the FM band output of the branching filter 40 by an angle θ2, whereby the FM band output provided by the glass antenna 20 and the FM band output provided by the glass antenna 22 are phase-adjusted. This phase adjustment is performed so as to secure high sensitivity and directivity factoring in the spatial distance difference between the glass antennas 20, 22 and the cable length difference between the coaxial cables 32, 36, and so as to realize a broad band factoring in the frequency characteristics of the glass antennas 20, 22 (e.g., θ1–θ2=60°, 90°, etc.). The phase-adjusted FM band outputs are then combined by the combining circuit 50.

In this structure, therefore, the FM band outputs of the glass antennas 20, 22 are combined factoring in the spatial distance difference between the glass antennas 20, 22, the cable length difference between the coaxial cables 32, 36, and the frequency characteristics of the glass antennas 20, 22. Hence, the vehicular antenna device 10 of this embodiment secures high-level FM-band reception sensitivity in all directions as indicated in FIG. 3B, and achieves broadband reception as indicated in FIG. 4.

In this embodiment, the FM band outputs provided by the glass antennas 20, 22 are subjected to phase adjustment by the phase-shift circuits 46, 48. Therefore, it is not necessary to specially contrive an antenna pattern formed on a glass pane of the vehicle 12 in order to improve the directivity and the reception sensitivity of the FM band. Therefore, according to the embodiment, it is possible to reduce the man-hours needed for hardware development of antenna elements in securing good FM band reception sensitivity, and to reduce the development costs.

If the combination of AM band outputs or the combination of FM band outputs is performed at a site that is unshielded and exposed to outside, for example, if coaxial cables are connected by a technique in which the covering of the cables are peeled and the core wires arc connected by a single-line connection manner, noise intrusion may occur. Furthermore, if such a site of combination is not grounded, the outer conductors of the coaxial cables 32, 36, 58 connected to the site of combination function as antennas so that output components from the glass antennas 20, 22 may leak. As a result, there occurs inconvenience of reduced reception sensitivity and changed directivity.

In the embodiment, however, the combination of AM band outputs is performed by the combining circuit 44 contained in the shield case 42, and the combination of FM band outputs is performed by the combining circuit 50 contained in the shield case 42. Since the shield case 42 performs the function of removing the influences of lines of magnetic forces or electrostatic coupling from outside, intrusion of external noise into the combined AM band output produced by the combining circuit 44 and the combined FM band output produced by the combining circuit 50 is prevented.

Furthermore, in the embodiment, the shield case 42 is grounded to the vehicle body. The outer conductors of the coaxial cables 32, 36 at the antenna feeding point side are grounded to the vehicle body, and the outer conductors of the coaxial cables 32, 36 at the branching filter side and the outer conductor of the coaxial cable 58 are grounded to the vehicle body. Therefore, the outer conductors of the coaxial cables 32, 36, 58 do not function as antennas. Thus, leakage of output components from the glass antennas 20, 22 is avoided.

If the outer conductors of the coaxial cables 32, 36, 58 are grounded to the vehicle body, outside the shield case 42, noise intrudes at the site of grounding, resulting in degraded reception performance. In the embodiment, however, the outer conductors of the coaxial cables 32, 36 at the branching filter side and the outer conductor of the coaxial cable 58 are grounded to the vehicle body within the shield case 42. This structure reliably prevents noise intrusion, and reliably prevents leakage of antenna output.

Since the vehicular antenna device 10 of the invention reliably prevents intrusion of external noise at the time of combination of antenna outputs, and reliably prevents leakage of antenna output as described above, deterioration in antenna reception sensitivity can be prevented, and change in directivity can be prevented. Thus, good improvement in reception performance can be achieved.

In this embodiment, the AM band output and the FM band output are subjected to impedance matching by the amplifier circuits 52, 54. According to this structure, since the AM band output and the FM band output are not simply combined in a parallel fashion, high-frequency impedance reduction is avoided, and sufficiently high antenna efficiency can be secured. Furthermore, as the AM band output and the FM band output do not interfere with each other, adjustment in directivity and sensitivity can easily be performed.

In the first embodiment, the antenna may be formed as the glass antennas 20, 22. Likewise, the combining circuit may be formed as the combining circuits 44, 50. The first combining circuit may be formed as the combining circuit 44, and the second combining circuit may be formed as the combining circuit, respectively. The output circuit may be formed as the amplifier circuits 52, 54.

Second Embodiment

Figure 5:
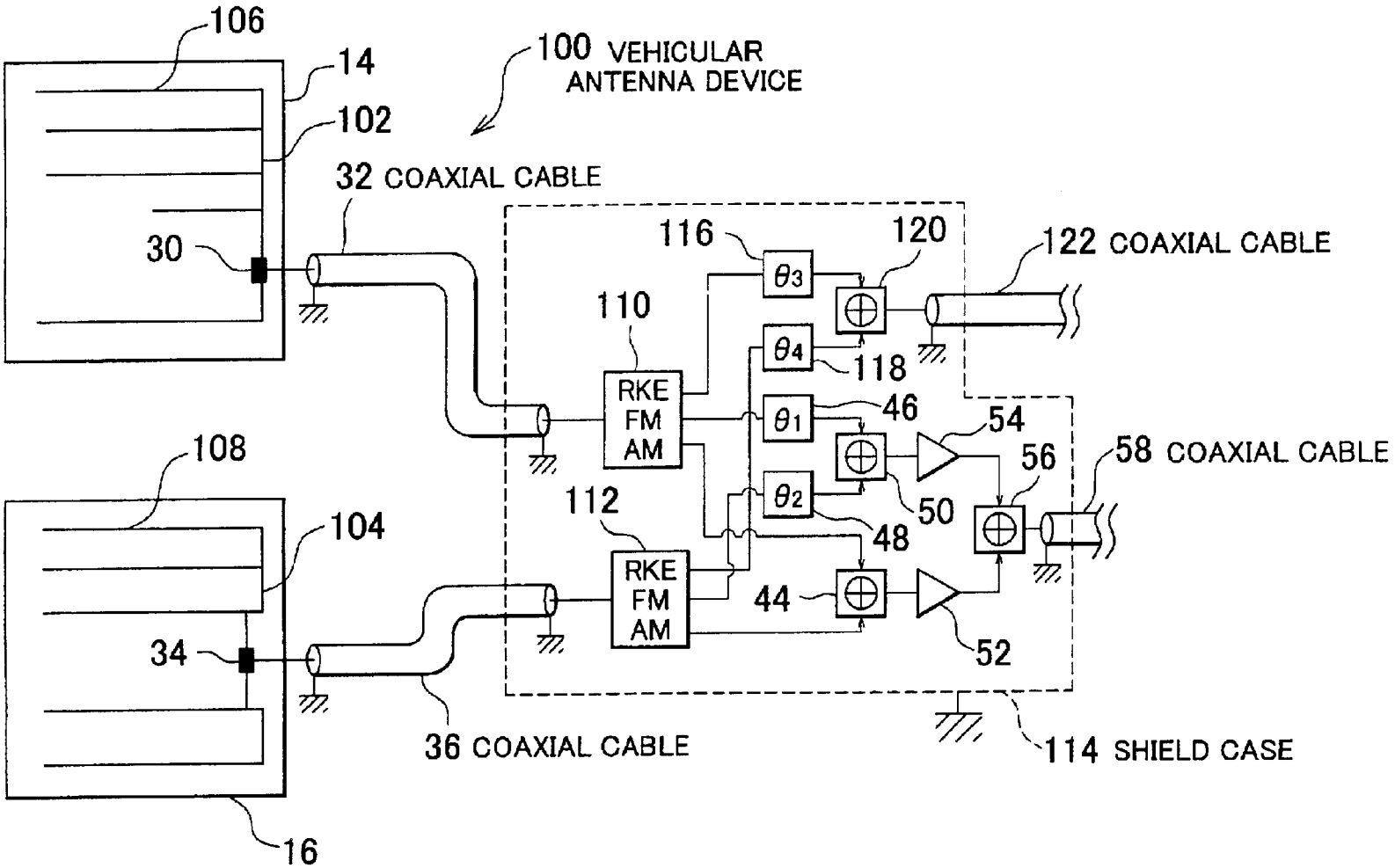
FIG. 5 is a diagram illustrating the structure of a vehicular antenna device in accordance with a second embodiment of the invention.

Next, a second embodiment of the invention will be described with reference to FIG. 5. FIG. 5 is a diagram illustrating the structure of a vehicular antenna device 100 of this embodiment. Components and the like of this embodiment comparable to those of the first embodiment are represented by comparable reference characters in FIG. 5, and will not be described. In the second embodiment, the vehicle is equipped with a key-less entry system (not shown) for remotely locking and unlocking vehicle doors in a non-contact manner. The key-less entry system includes a vehicle-installed device that controls the locking and unlocking of the vehicle doors, and a portable device carried by a vehicle driver or the like. Upon receiving electromagnetic waves in a band of 300 MHz from the portable device, the vehicle-installed device locks or unlocks the vehicle doors.

The vehicular antenna device 100 has glass antennas 102, 104 that are provided on quarter glass panes 14, 16 of the vehicle. The glass antennas 102, 104 have antenna elements 106, 108 that are provided as patterns formed on the quarter glass panes 14, 16 by, for example, baking an electrically conductive paste on the glass panes. The glass antennas 102, 104 are capable of receiving electromagnetic waves of the 300-MHz band together with AM radio broadcast waves, FM radio broadcast waves, and TV broadcast waves. A coaxial cable 32 is connected at an end thereof to a feeding point 30 of the glass antenna 102. A coaxial cable 36 is connected at an end thereof to a feeding point 34 of the glass antenna 104.

The other end of the coaxial cable 32 is connected to a branching filter 110. Another end of the coaxial cable 36 is connected to a branching filter 112. The branching filters 110, 112 are supplied with electric power corresponding to the electromagnetic waves received by the glass antennas 102, 104. The branching filters 110, 112 perform functions of splitting the electromagnetic waves received by the glass antennas 102, 104 into different frequency bands of the AM band, the FM band, and the 300-MHz band. The branching filters 110, 112 are both contained in a shield case 114 that is grounded to the body of the vehicle 12. The shield case 114 has a function of removing the influences of magnetic lines of force or electrostatic coupling from outside. The outer conductor of the coaxial cable 32 at the side of the branching filter 110 and the outer conductor of the coaxial cable 36 at the side of the branching filter 112 are grounded to the shield case 114 within the shield case 114.

An AM band output of the branching filter 110 and an AM band output of the branching filter 112 are connected to a combining circuit 44. An FM band output of the branching filter 110 is connected to a phase-shift circuit 46. An FM band output of the branching filter 112 is connected to a phase-shift circuit 48. A 300-MHz band output of the branching filter 110 is connected to a phase-shift circuit 116. A 300-MHz band output of the branching filter 112 is connected to a phase-shift circuit 118. The phase-shift circuit 116 and the phase-shift circuit 118 perform phase adjustment of the 300-MHz band output produced by the branching filter 110 and the 300-MHz band output produced by the branching filter 112, respectively.

A 300-MHz band output of the branching filter 116 and a 300-MHz band output of the branching filter 118 are connected to a combining circuit 120. The combining circuit 120 combines the 300-MHz band outputs of the phase-shift circuits 116, 118, that is, the 300-MHz band outputs provided by the glass antennas 102, 104. The branching filters 110, 112, the phase-shift circuits 116, 118, and the combining circuit 120 are all contained in the shield case 114.

An output of the combining circuit 120 is connected to an end of a coaxial cable 122. The coaxial cable 122 transmits a combined output produced by the combining circuit 120 from the 300-MHz band outputs provided by the glass antennas 102, 104. The outer conductor of the coaxial cable 122 at an end thereof is grounded to the shield case 114 within the shield case 114. The other end of the coaxial cable 122 is connected to a key-less entry receiver. The receiver performs appropriate signal processing of the combined output supplied from the combining circuit 120.

In this structure, the wavelength of 300-MHz band electromagnetic waves (e.g., about 1 m in the case of electromagnetic waves of 300 MHz) is about half the distance between the quarter glass panes 14, 16. Depending on the wavelength for use, the phase difference caused by the different spatial distances of the two glass antennas needs to be considered in combining the FM band electromagnetic waves received by the glass antennas.

In this embodiment, therefore, the phase-shift circuit 116 shifts the phase of the 300-MHz band output of the branching filter 110 by an angle θ3, and the phase-shift circuit 118 shifts the phase of the 300-MHz band output of the branching filter 112 by an angle θ4, whereby the 300-MHz band output provided by the glass antenna 102 and the 300-MHz band output provided by the glass antenna 104 are phase-adjusted. This phase adjustment is performed so as to secure high sensitivity and directivity factoring in the spatial distance difference between the glass antennas 102, 104 and the cable length difference between the coaxial cables 32, 36 (e.g., θ3–θ4=60°, 90°, etc.). The phase-adjusted 300-MHz band outputs are then combined by the combining circuit 120.

In this structure, therefore, the 300-MHz band outputs of the glass antennas 102, 104 are combined factoring in the spatial distance difference between the glass antennas 102, 104, and the cable length difference between the coaxial cables 32, 36. Hence, the vehicular antenna device 100 of this embodiment secures high-level 300-MHz band reception sensitivity in all directions.

In this embodiment, the combination of 300-MHz band outputs is performed at the combining circuit 120 contained in the shield case 114. Since the shield case 114 performs the function of removing the influences of lines of magnetic forces or electrostatic coupling from outside, intrusion of external noise into the combined 300-MHz band output produced by the combining circuit 120 is prevented.

Furthermore, in the embodiment, the shield case 114 is grounded to the vehicle body. The outer conductor of the coaxial cable 122, as well as the outer conductors of the coaxial cables 32, 36, 58, is grounded to the vehicle body via the shield case 114. Therefore, the outer conductor of the coaxial cable 122 does not function as an antenna. Thus, leakage of output components from the glass antennas 110, 112 is avoided. Still further, since the outer conductor of the coaxial cable 58 is grounded within the shield case 114, noise intrusion can be reliably prevented, and leakage of antenna output can be reliably prevented.

Thus, similar to the above-described vehicular antenna device 10 of the first embodiment, the vehicular antenna device 100 of the second embodiment reliably prevents intrusion of external noise at the time of combination of antenna outputs, and reliably prevents leakage of antenna output as described above. Therefore, deterioration in antenna reception sensitivity can be prevented, and change in directivity can be prevented. Thus, good improvement in reception performance can be achieved.

In the second embodiment, the antenna is formed as the glass antennas 102, 104, and the combining circuit and the second combining circuit is formed as the combining circuit 120.

In the first and second embodiments, the glass antennas 20, 22, 102, 104 are used as antennas for receiving electromagnetic waves of the AM radio broadcast band, antennas for receiving electromagnetic waves of the FM radio and TV broadcast band, and antennas for receiving electromagnetic waves of the 300-MHz band for the key-less entry system. However, it is also possible to adopt a structure in which those antennas are used as antennas for receiving electromagnetic waves of other bands.

Furthermore, although in the first and second embodiments, a plurality of glass antennas are provided on the quarter glass panes 14, 16 in rearward side surfaces of the vehicle body, this structure does not restrict the invention. For example, glass antennas may be provided on a window glass pane in a forward portion of the vehicle body, or a window glass pane in a rearward portion of the vehicle body as indicated in FIG. 6.

Figure 6:
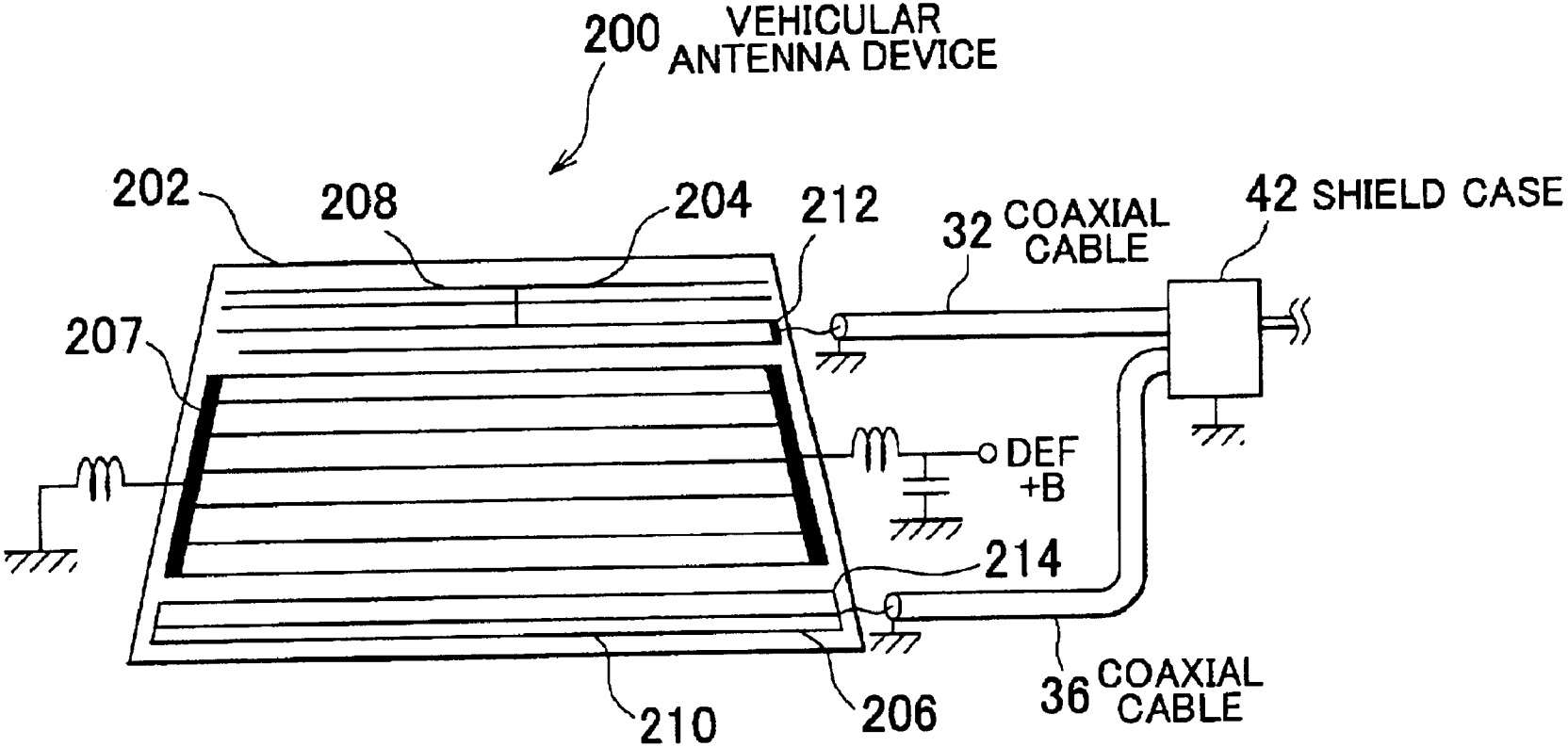
FIG. 6 is a diagram illustrating a vehicular antenna device in accordance with a modification of the invention.

FIG. 6 is a diagram illustrating a vehicular antenna device 200 in accordance with a modification in the invention. Components and the like of the device comparable to those described above are represented by comparable reference characters, and will not be described below. In this modification, the vehicular antenna device 200 includes glass antennas 204, 206 provided on a rear glass pane 202 of a vehicle body. The rear glass pane 202 is provided with a defogger pattern 207 for removing condensed moisture from the rear glass pane. The glass antenna 204 has an antenna element 208 that is provided as a pattern formed on an upper marginal portion of the rear glass pane 202 above the defogger pattern 207 by, for example, baking an electrically conductive paste. Similarly, the glass antenna 206 has an antenna element 210 that is provided as a pattern formed on a lower marginal portion of the rear glass pane 202 below the defogger pattern 207 by, for example, baking an electrically conductive paste.

Similar to the glass antennas 20, 22 in the first embodiment, the glass antennas 204, 206 are capable of receiving AM radio broadcast waves, FM radio broadcast waves, and TV broadcast waves. The two glass antennas 204, 206 have frequency characteristics different from each other. A coaxial cable 32 is connected at an end thereof to a feeding point 212 of the glass antenna 204. A coaxial cable 36 is connected at an end thereof to a feeding point 214 of the glass antenna 206.

Similar to the vehicular antenna device 10 of the first embodiment, the vehicular antenna device 200 achieves improved reception sensitivity for the AM band, and secures high-level FM-band reception sensitivity in all directions, and achieves broadband reception for the FM band. Furthermore, the vehicular antenna device 200 reliably prevents intrusion of external noise and degradation of reception sensitivity at the time of combination of signals of the AM band and the FM band, and secures good reception performance.

Third Embodiment

A third embodiment of the invention will next be described with reference to FIG. 7.

Figure 7:
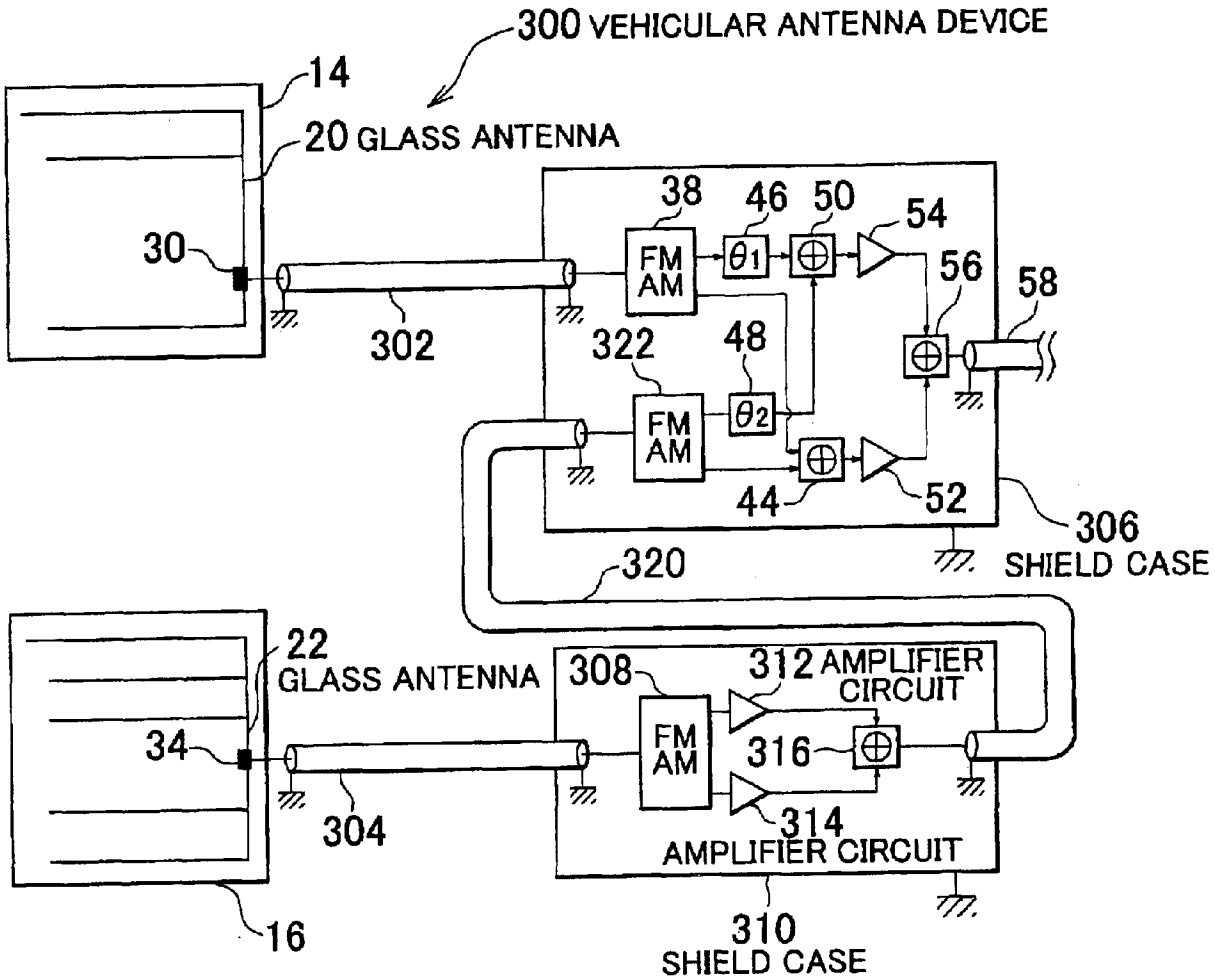
FIG. 7 is a diagram illustrating the structure of a vehicular antenna device in accordance with a third embodiment of the invention.

FIG. 7 is a diagram illustrating the structure of a vehicular antenna device 300 in accordance with the third embodiment. Components and the like of the device comparable to those described above are represented by comparable reference characters, and the description thereof will be omitted or simplified below. In the vehicular antenna device 300, an end of a coaxial cable 302 is connected to a feeding point 30 of a glass antenna 20 provided on a quarter glass pane 14. An end of a coaxial cable 304 is connected to a feeding point 34 of a glass antenna 22 provided on a quarter glass pane 16. The coaxial cables 302, 304, as antenna cables, transmit electric powers corresponding to the electromagnetic waves received by the glass antennas 20, 22. The outer conductor of the coaxial cable 302 at the side of the feeding point 30 and the outer conductor of the coaxial cable 304 at the side of the feeding point 34 are grounded to the body of the vehicle 12.

The other end of the coaxial cable 302 is connected to a branching filter 38. The branching filter 38 is contained in a shield case 306 that is grounded to the vehicle body of the vehicle 12. The shield case 306 performs a function of removing the influences of magnetic lines of force or electrostatic coupling from outside. The outer conductor of the coaxial cable 302 at the side of the branching filter 38 is grounded to the shield case 306 within the shield case 306. The shield case 306 is disposed near the glass antenna 20. That is, the path length of transmission via the coaxial cable 302 between the glass antenna 20 and the shield case 306 is generally less than 30 cm (at most about 1 m).

The other end of the coaxial cable 304 is connected to a branching filter 308. The branching filter 308 is supplied with an electric power corresponding to the electromagnetic waves received by the glass antenna 22. The branching filter performs a function of splitting the electromagnetic waves received by the glass antenna 22 into different frequency bands of the AM and FM bands. The branching filter 308 is contained in a shield case 310 that is grounded to the body of the vehicle 12. The shield case 310 performs a function of removing the influences of magnetic lines of force or electrostatic coupling from outside. The outer conductor of the coaxial cable 304 at the side of the branching filter 308 is grounded to the shield case 310 within the shield case 310. The shield case 310 is disposed near the glass antenna 22. That is, the path length of transmission via the coaxial cable 304 between the glass antenna 22 and the shield case 310 is generally less than 30 cm (at most about 1 meter). Therefore, the shield cases 306, 310 are at least about 1.5 m apart from each other since the quarter glass panes 14, 16 are about 2 m apart from each other.

An FM band output of the branching filter 308 is connected to an amplifier circuit 312. An AM band output of the branching filter 308 is connected to an amplifier circuit 314. The amplifier circuit 312 amplifies the FM band output provided by the glass antenna 22, and the amplifier circuit 314 amplifies the AM band output provided by the glass antenna 22. An output of the amplifier circuit 312 and an output of the amplifier circuit 314 are connected to a mixer 316. The mixer 316 combines the outputs of the amplifier circuits 312, 314, that is, the amplified AM band output and the amplified FM band output derived from the glass antenna 22. The amplifier circuits 312, 314 and the mixer 316 are all contained in the shield case 310.

An output of the mixer 316 is connected to an end of a coaxial cable 320. The coaxial cable 320 transmits a combined output produced by the mixer 316 from the amplified AM and FM band outputs derived from the glass antenna 22. The outer conductor of the coaxial cable 320 at an end thereof is grounded to the shield case 310 within the shield case 310.

The other end of the coaxial cable 320 is connected to a branching filter 322. The branching filter 322 is supplied with an electric power corresponding to the electromagnetic waves amplified after being received by the glass antenna 22. The branching filter 322 performs a function of splitting the electromagnetic waves amplified after being received by the glass antenna 22 into different frequency bands of the AM and FM bands. The branching filter 322 is contained in the shield case 306. The outer conductor of the coaxial cable 320 at the side of the branching filter 322 is grounded to the shield case 306 within the shield case 306. Therefore, the coaxial cable 320 has a length that is greater than the distance between the shield cases 306, 310 (at least about 1.5 m).

An AM band output of the branching filter 38 and an AM band output of the branching filter 322 are connected to a combining circuit 44 that combines the AM band outputs of the two branching filters. An FM band output of the branching filter 38 is connected to a phase-shift circuit 46. An FM band output of the branching filter 322 is connected to a phase-shift circuit 48. The phase-shift circuit 46 and the phase-shift circuit 48 perform phase-shift adjustment of the FM band output produced by the branching filter 38 and the FM band output produced by the branching filter 322, respectively. The combining circuits 44, 50, the phase-shift circuits 46, 48, the amplifier circuits 52, 54, and the mixer 56 are all contained in the shield case 306.

In this structure, AM band electromagnetic waves are received by the two glass antennas 20, 22, and the AM band electromagnetic waves received by the two glass antennas 20, 22 are combined by the combining circuit 44 in an in-phase manner. Since the wavelength of electromagnetic waves in the AM band is sufficiently longer than the distance between the quarter glass panes 14, 16 where the glass antennas 20, 22 are provided, it is not necessary to consider the phase difference caused by different spatial distances of the two glass antennas 20, 22, in combining the AM band electromagnetic waves received by the two antennas. In this respect, if the electromagnetic waves received by the two glass antennas 20, 22 are in-phase combined as in this embodiment, deterioration in the AM band reception sensitivity caused by the phase difference between the electromagnetic waves received by the two antennas is avoided. Therefore, according to the vehicular antenna device 300 of the embodiment, since the electromagnetic waves received by the two glass antennas 20, 22 are in-phase combined, the effective area of opening of pattern as the whole antenna is increased. As a result, the AM band reception sensitivity is improved.

In the above-described structure, the phase-shift circuit 46 shifts the phase of the FM band output of the branching filter 38 by an angle θ1, and the phase-shift circuit 48 shifts the phase of the FM band output of the branching filter 322 by an angle θ2, whereby the FM band output provided by the glass antenna 20 and the FM band output provided by the glass antenna 22 are phase-adjusted. This phase adjustment is performed so as to secure high sensitivity and directivity factoring in the spatial distance difference between the glass antennas 20, 22, and so as to realize widened-band reception factoring in the frequency characteristics of the glass antennas 20, 22. The phase-adjusted FM band outputs are then combined by the combining circuit 50.

Since the wavelength of electromagnetic waves of the FM band is about twice the distance between the quarter glass panes 14, 16, the phase difference caused by the different special distances of the two glass antennas needs to be considered in order to appropriately combine the FM band electromagnetic waves received by the two glass antennas 20, 22. In the structure of the embodiment, however, the FM band outputs of the glass antennas 20, 22 are combined after phase-shifts of the FM band outputs factoring in the spatial distance difference between the two antennas 20, 22 and the frequency characteristics of the antennas 20, 22. Therefore, this embodiment secures high-level reception sensitivity for the FM band in all directions, and realizes widened-band reception.

Furthermore, in the structure of the embodiment, the combination of AM band outputs is performed by the combining circuit 44 contained in the shield case 306, and the combination of FM band outputs is performed by the combining circuit 50 contained in the shield case 306. Therefore, owing to the function of the shield case 306, intrusion of external noise into the combined AM band output produced by the combining circuit 44 and the combined FM band output produced by the combining circuit 50 is prevented.

Furthermore, in the structure of the embodiment, the shield cases 306, 310 are grounded to the vehicle body. The outer conductors of the coaxial cables 302, 304 at the antenna feeding point side are grounded to the vehicle body. The outer conductors of the coaxial cables 302, 304 at the branching filter side, the outer conductor of the coaxial cable 320 at both ends, and the outer conductor of the coaxial cable 58 are grounded within the shield cases 306, 310 to the vehicle body via the shield cases 306, 310. Therefore, according to the vehicular antenna device 300 of this embodiment, the coaxial cables 302, 304, 320, 58 do not function as antennas, so that leakage of output components of the glass antennas 20, 22 is reliably prevented, and noise intrusion is reliably prevented.

Figure 8:
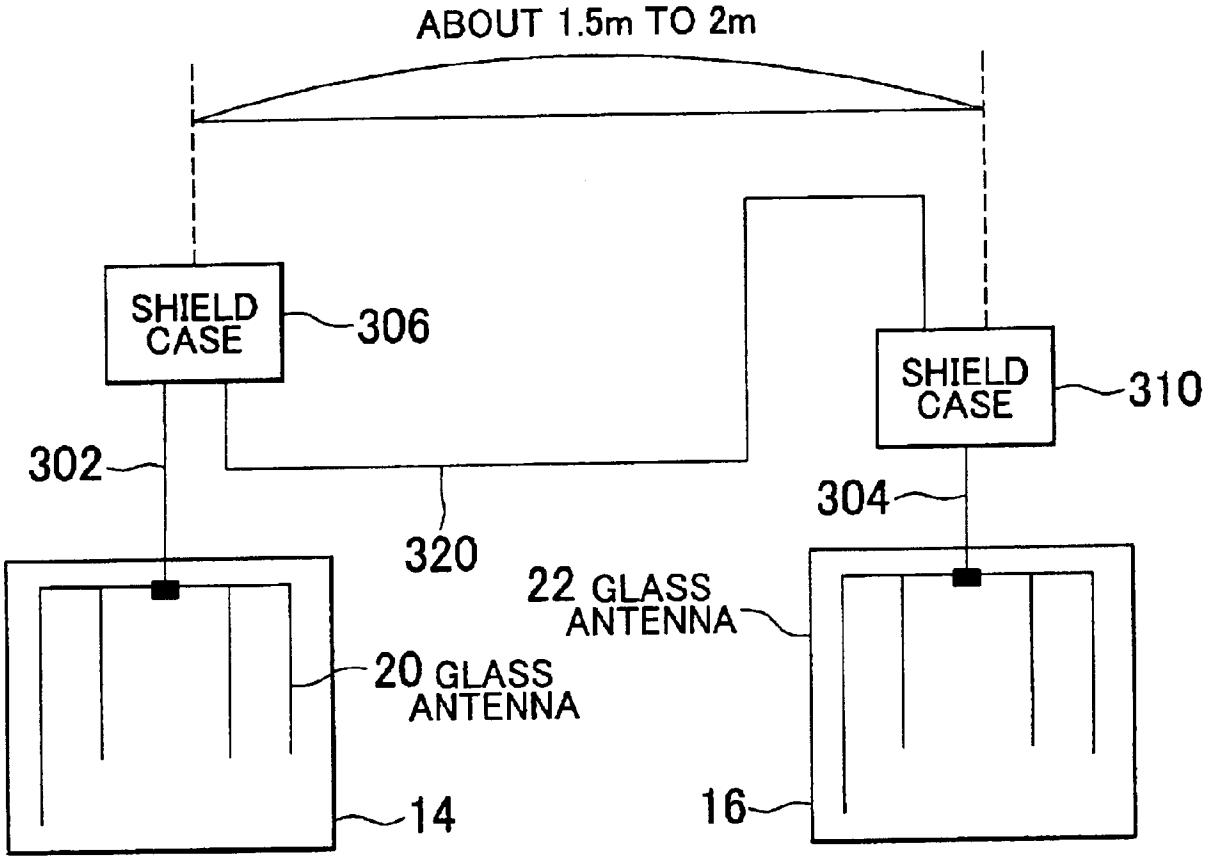
FIG. 8 is a schematic diagram illustrating a positional relationship between the glass antennas and the shield cases in the vehicular antenna device of the embodiment.

FIG. 8 is a schematic diagram illustrating a positional relationship between the glass antennas 20, 22 and the shield cases 306, 310 in the vehicular antenna device 300 of the embodiment.

Referring to FIG. 8, the shield case 306 containing both the combining circuit 44 that combines the AM band outputs of the glass antennas 20, 22 and the combining circuit 50 that combines FM band outputs of the glass antennas 20, 22 is disposed near the glass antenna 20 as indicated in FIG. 8. Specifically, the distance of the transmission path from the feeding point 30 of the glass antenna 20 to the shield case 306 via the coaxial cable 302 is as short as about 30 cm, whereas the distance of the transmission path from the feeding point 34 of the glass antenna 22 to the shield case 306 via the coaxial cables 304, 320 is as long as about 1.5 m to 2 m. The transmission loss that occurs during transmission of antenna output increases with increases in the transmission path length. In this respect, the antenna output provided by the glass antenna 20 doest not greatly attenuate whereas the antenna output provided by the glass antenna 22 is subject to relatively great attenuation in this embodiment. Therefore, if the antenna outputs of the two antennas are simply combined without being amplified, the reception sensitivity deteriorates, and good reception performance cannot be obtained.

In this embodiment, however, the shield case 310 containing the amplifier circuits 312, 314 is disposed near the glass antenna 22, from which a long transmission path that is longer than about 1.5 m extends to the shield case 306. The amplifier circuit 312 amplifies the FM band output of the glass antenna 22 that is split from the antenna output to the FM band side. The amplifier circuit 314 amplifies the AM band output of the glass antenna 22 that is split from the antenna output to the AM band side. That is, the FM band output of the glass antenna 22 is amplified by the amplifier circuit 312 before being supplied to the shield case 306 via the coaxial cable 320, and the AM band output of the glass antenna 22 is amplified by the amplifier circuit 314 before being supplied to the shield case 306 via the coaxial cable 320.

Therefore, in the vehicular antenna device 300 of this embodiment, the FM band and AM band antenna outputs provided by the glass antenna 22 are supplied to the combining circuits 44, 50 contained in the shield case 306 without the problem of attenuation due to transmission loss, despite the long transmission path of about 1.5 m to 2 m from the glass antenna 22 to the shield case 306. Hence, the vehicular antenna device 300 of this embodiment is able to prevent reception sensitivity degradation caused by great transmission loss that occurs in the transmission of antenna output of the glass antenna 22, and is able to secure good reception performance.

In the third embodiment, the amplifier circuit is formed as the amplifier circuits 312, 314, and the shield case for the amplifier circuit is formed as the shield case 310.

Fourth Embodiment

Figure 9:
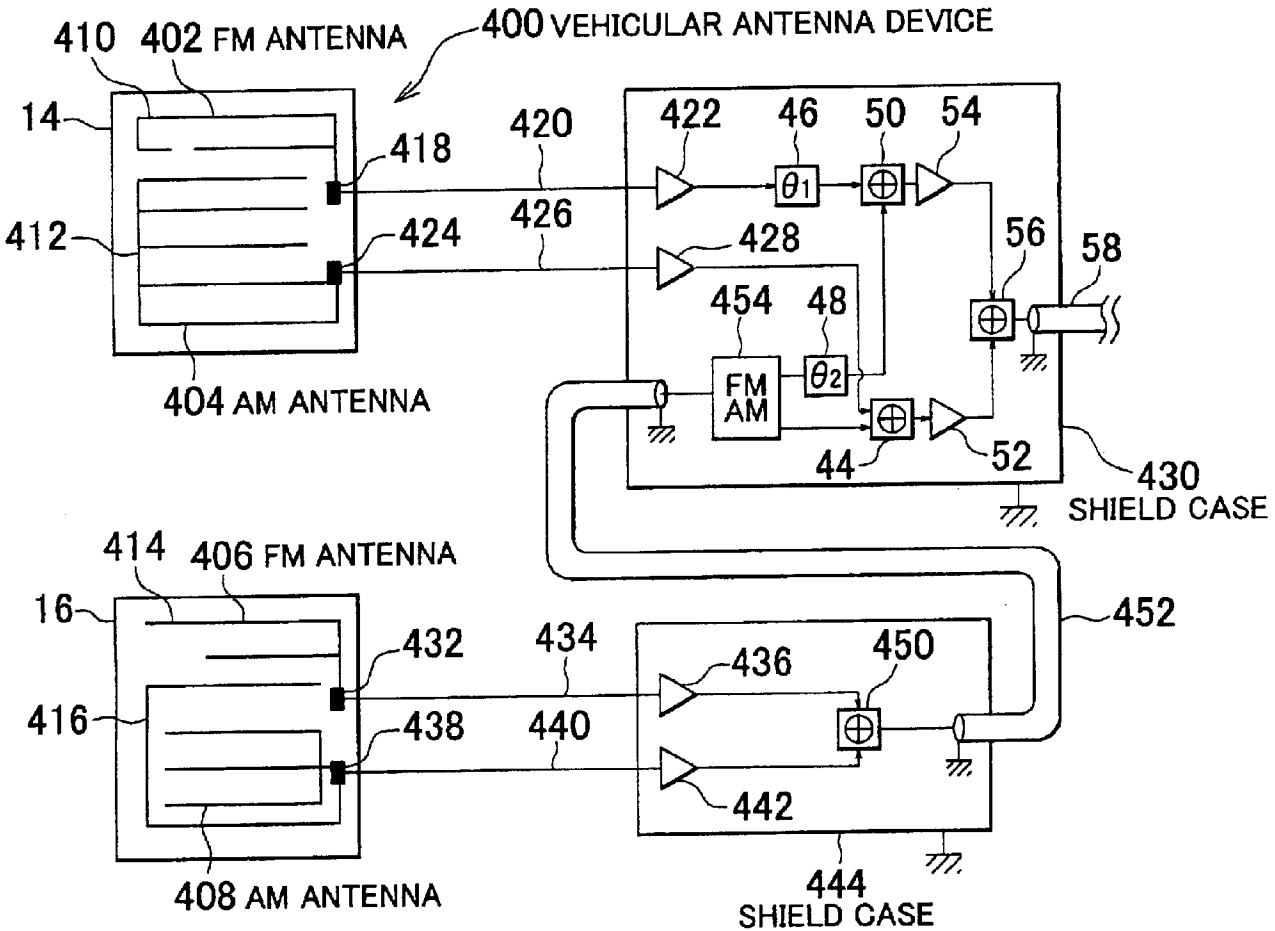
FIG. 9 is a diagram illustrating the structure of a vehicular antenna device in accordance with a fourth embodiment of the invention.

A fourth embodiment of the invention will next be described with reference to FIG. 9. FIG. 9 is a diagram illustrating the structure of a vehicular antenna device 400 in accordance with the fourth embodiment. Components and the like of the device 400 in FIG. 9 comparable to those shown in FIG. 7 are represented by comparable reference characters, and the description thereof will be omitted or simplified below. The vehicular antenna device 400 includes glass antennas 402, 404 provided on a quarter glass pane 14, and glass antennas 406, 408 provided on a quarter glass pane 16. Each of the glass antennas 402 to 408 has an antenna element 410 to 416 that is provided as a pattern formed on the quarter glass pane 14, 16 by, for example, baking an electrically conductive paste on the glass pane.

The glass antennas 402, 406 are able to receive FM radio broadcasting and TV (VHF) broadcasting of a very-high-frequency band (specifically, 76 MHz to 108 MHz), and TV (UHF) broadcasting of a UHF band (specifically, 470 MHz to 770 MHz). The glass antenna 402 has a frequency characteristic of having a sensitivity peak in the band of FM radio broadcasting. The glass antenna 406 has a frequency characteristic of having a sensitivity peak in the band of TV (VHF) broadcasting. The two glass antennas 402, 406 have different frequency characteristics. The glass antennas 404, 408 are able to receive AM radio broadcasting of a medium-frequency band (specifically, 522 kHz to 1629 kHz). Hereinafter, the glass antennas 402, 406 will be referred to as "FM antennas 402, 406", and the glass antennas 404, 408 will be referred to as "AM antennas 404, 408".

A feeding point 418 of the FM antenna 402 is connected to an amplifier circuit 422 via an antenna cable 420. A feeding point 424 of the AM antenna 404 is connected to an amplifier circuit 428 via an antenna cable 426. The amplifier circuit 422 amplifies the FM band output provided by the FM antenna 402. The amplifier circuit 428 amplifies the AM band output provided by the AM antenna 404.

The amplifier circuits 422, 428 are contained in a shield case 430 that is grounded to the body of a vehicle 12. The shield case 430 performs a function of removing the influences of magnetic lines of force or electrostatic coupling from outside. The shield case 430 is disposed near the glass antennas 402, 404. The distance of transmission path between the glass antennas 402, 404 and the shield case 430 via the antenna cables 420, 426 is generally less than 30 cm (at most about 1 meter).

A feeding point 432 of the FM antenna 406 is connected to an amplifier circuit 436 via an antenna cable 434. A feeding point of the AM antenna 408 is connected to an amplifier circuit 442 via an antenna cable 440. The amplifier circuit 436 amplifies the FM band output provided by the FM antenna 406. The amplifier circuit 442 amplifies the AM band output provided by the AM antenna 408.

The amplifier circuits 436, 442 are contained in a shield case 444 that is grounded to the body of the vehicle 12. The shield case 444 performs a function of removing the influences of magnetic lines of force or electrostatic coupling from outside. The shield case 444 is disposed near the glass antennas 406, 408. The distance of transmission path between the glass antennas 406, 408 and the shield case 444 via the antenna cables 434, 440 is generally less than 30 cm (at most about 1 meter). Therefore, the shield cases 430, 444 are at least about 1.5 m apart from each other since the quarter glass panes 14, 16 are about 2 m apart from each other.

An output of the amplifier circuit 436 and an output of the amplifier circuit 442 are connected to a mixer 450 that is contained in the shield case 444. The mixer 450 combines the outputs of the amplifier circuits 436, 442, that is, the amplified FM and AM band outputs derived from the glass antennas 406, 408. An output of the mixer 450 is connected to an end of a coaxial cable 452. The coaxial cable 452 transmits a combined output produced by the mixer 450 from the amplified FM band output derived from the glass antenna 406 and the amplified AM band output derived from the glass antenna 408.*d* The outer conductor of the coaxial cable 452 at an end is grounded to the shield case 444, within the shield case 444.

The other end of the coaxial cable 452 is connected to a branching filter 454 that is contained in the shield case 430. The branching filter 454 is supplied with an electric power corresponding to the electromagnetic waves amplified after being received by the glass antennas 406, 408. The branching filter 454 performs a function of separating the supplied electromagnetic waves into the FM band electromagnetic waves amplified after being received by the glass antenna 406, and the AM band electromagnetic waves amplified after being received by the glass antenna 408. The outer conductor of the coaxial cable 452 at the side of the branching filter 454 is grounded to the shield case 430, within the shield case 430. Therefore, the coaxial cable 452 has a length that is greater than the distance between the shield cases 430, 444 (at least about 1.5 m).

An AM band output of the amplifier circuit 428 and an AM band output of the branching filter 454 are connected to a combining circuit 44 that combines the AM band outputs. An FM band output of the amplifier circuit 422 is connected to a phase-shift circuit 46. An FM band output of the branching filter 454 is connected to a phase-shift circuit 48. The phase-shift circuit 46 performs phase adjustment of the FM band output provided by the FM antenna 402. The phase-shift circuit 48 performs phase adjustment of the FM band output provided by the FM antenna 406. The combining circuits 44, 50, the phase-shift circuits 46, 48, the amplifier circuits 52, 54, and the mixer 56 are all contained in the shield case 430.

In this embodiment, electromagnetic waves of the AM band are received by the two AM antennas 404, 408, and the electromagnetic waves received by the two AM antennas are combined by the combining circuit 44 in an in-phase manner. Since the wavelength of the AM band electromagnetic waves is sufficiently longer than the distance between the quarter glass panes 14, 16, the phase difference caused by the different special distances of the two AM antennas 404, 408 needs to be considered in order to appropriately combine the AM band electromagnetic waves received by the two antennas. In this respect, if the electromagnetic waves received by the two AM antennas 404, 408 are in-phase combined as in this embodiment, deterioration in the AM band reception sensitivity caused by the phase difference between the electromagnetic waves received by the two antennas is avoided. Therefore, according to the vehicular antenna device 400 of the embodiment, as the electromagnetic waves received by the two AM antennas 404, 408 are in-phase combined, the effective area of opening of pattern as the whole antenna is increased. As a result, the AM band reception sensitivity is improved.

In the above-described structure, the phase-shift circuit 46 shifts the phase of the FM band output of the amplifier circuit 422 by an θ1, and the phase-shift circuit 48 shifts the phase of the FM band output of the branching filter 454 by an angle θ2, whereby the FM band output provided by the FM antenna 402 and the FM band output provided by the FM antenna 406 are phase-adjusted. This phase adjustment is performed so as to secure high sensitivity and. directivity factoring in the spatial distance difference between the FM antennas 402, 406, and so as to realize widened-band reception factoring in the frequency characteristics of the FM antennas 402, 406. The phase-adjusted FM band outputs are then combined by the combining circuit 50. Therefore, in the vehicular antenna device 400 of the embodiment, since the FM band outputs of the FM antennas 402, 406 are combined after phase-shifts of the outputs factoring in the spatial distance difference between the two FM antennas 402, 406 and the frequency characteristics of the two antennas 402, 406. Hence, the vehicular antenna device 400 is able to secure high-level reception sensitivity for the FM band in all directions, and to realize broadband reception.

Furthermore, in the structure of the embodiment, the combination of AM band outputs is performed by the combining circuit 44 contained in the shield case 430, and the combination of FM band outputs is performed by the combining circuit 50 contained in the shield case 430. Therefore, owing to the function of the shield case 430, intrusion of external noise into the combined AM band output produced by the combining circuit 44 and the combined FM band output produced by the combining circuit 50 is prevented.

Furthermore, in the structure of the embodiment, the shield cases 430, 444 are grounded to the vehicle body. The outer conductor of the coaxial cable 452 at both ends and the outer conductor of the coaxial cable 58 are grounded within the shield cases 430, 444 to the vehicle body via the shield cases 430, 444. Therefore, according to the vehicular antenna device 400 of this embodiment, the coaxial cables 452, 58 do not function as antennas, so that leakage of output components of the glass antennas is reliably prevented, and noise intrusion is reliably prevented.

Further, in the embodiment, the shield case 444 containing the amplifier circuits 436, 442 is disposed near the glass antennas 406, 408, which have a long transmission path distance of about 1.5 m to 2 m to the shield case 430. The amplifier circuits 422, 428 are provided near the glass antennas 402, 404, which have a relatively short transmission path distance to the shield case 430. The amplifier circuit 436 amplifies the FM band output provided by the FM antenna 406. The amplifier circuit 442 amplifies the AM band output provided by the AM antenna 408. The amplifier circuit 422 amplifies the FM band output provided by the FM antenna 402. The amplifier circuit 428 amplifies the AM band output provided by the AM antenna 404.

That is, the FM band output of the FM antenna 406 is amplified by the amplifier circuit 436 before being supplied to the shield case 430 via the coaxial cable 452. The AM band output of the AM antenna 408 is amplified by the amplifier circuit 442 before being supplied to the shield case 430 via the coaxial cable 452. The FM band output of the FM antenna 402 is amplified by the amplifier circuit 422. The AM band output of the AM antenna 404 is amplified by the amplifier circuit 428.

Therefore, in the vehicular antenna device 400 of this embodiment, the FM band and AM band outputs provided by the glass antennas 406, 408 can be supplied to the combining circuits 44, 50 contained in the shield case 430 without the problem of attenuation due to transmission loss, despite the relatively long transmission path of about 1.5 m from the glass antennas 406, 408 to the shield case 430. Furthermore, as for the antennas 402, 404 having a relatively short transmission path distance to the shield case 430, the FM band output of the FM antenna 402 and the AM band output of the AM antenna 404 can be supplied to the combining circuits 44, 50 contained in the shield case 430 with compensation for not-so-great transmission loss. Hence, the vehicular antenna device 400 of this embodiment is able to prevent reception sensitivity degradation caused by an increase of transmission loss that occurs in the transmission of antenna outputs of the glass antennas 402 to 408, and is able to secure good reception performance.

The vehicular antenna device 400 of the embodiment combines the FM band outputs provided by a plurality of glass antennas, and combines the AM band outputs provided by a plurality of glass antennas. In accordance with the embodiment, it is conceivable to adopt a structure in which FM/AM purpose antennas are provided instead of the FM antennas 402, 406 and the AM antennas 404, 408, and the duel-purpose antennas are connected to a single antenna cable that is connected to a branching filter for splitting the antenna output into FM band output and AM band output. However, in the structure where FM band output and AM band output are separated by the branching filter, interference of the outputs with each other occurs due to a structural constraint. As a result, the reception sensitivity deteriorates due to antenna output loss.

In the embodiment, however, the FM antenna 402 and the AM antenna 404 are provided on the quarter glass pane 14, and the FM antenna 406 and the AM antenna 408 are provided on the quarter glass pane 16, and the outputs of the individual antennas are delivered toward the combining circuits 44, 50 via the corresponding antenna cables 420, 426, 434, 440. That is, the splitting of antenna outputs by a branching filter prior to transmission of the antenna outputs to the combining circuits 44, 50 is avoided, and therefore, intrusion of an antenna output to a different antenna output path does not occur.

Therefore, the vehicular antenna device 400 of the embodiment avoids antenna output loss related to employment of a branching filter, and is therefore able to prevent degradation in reception sensitivity for antenna outputs. Hence, the vehicular antenna device 400 of the embodiment secures good reception performance.

In the embodiment, the first antenna is formed as the AM antennas 404, 408, and the second antenna is formed as the FM antennas 402, 406. Furthermore, the amplifier circuit is formed as the amplifier circuits 422, 428, 436, 442, and the shield case for the amplifier circuit is formed as the shield case 444.

Although in the fourth embodiment, the FM band output and the AM band output provided by the FM antenna 402 and the AM antenna 404 on the quarter glass pane 14 provided near the shield case 430 are amplified by the amplifier circuits 422, 428 contained in the shield case 430, the use of the amplifier circuits 422, 428 for amplifying the antenna outputs is not altogether necessary, and can be omitted if the transmission loss of the antenna outputs is not considerably great.

Fifth Embodiment

Figure 10:
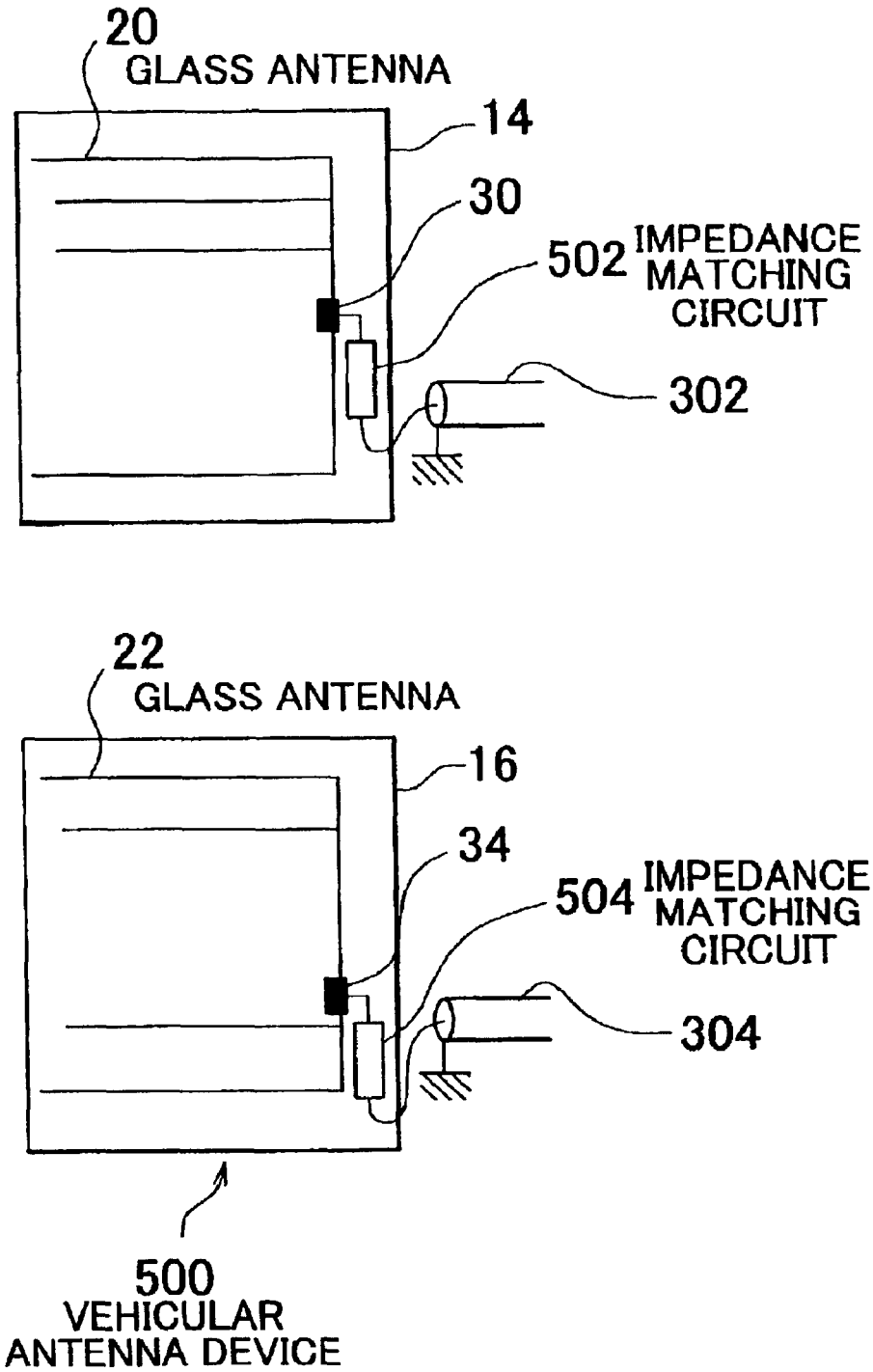
FIG. 10 is a diagram illustrating the structure of a vehicular antenna device in accordance with a fifth embodiment of the invention.

A fifth embodiment of the invention will next be described with reference to FIG. 10. FIG. 10 is a diagram illustrating the structure of a vehicular antenna device 500 in accordance with the embodiment. Components and the like of the device 500 in FIG. 10 comparable to those shown in FIGS. 1 and 7 are represented by comparable reference characters, and the description thereof will be omitted or simplified below. In the vehicular antenna device 500, an impedance matching circuit 502 is provided on a path connecting a coaxial cable 302 and a feeding point 30 of a glass antenna 20 provided on a quarter glass pane 14. An impedance matching circuit 504 is provided on a path connecting a coaxial cable 304 and a feeding point 34 of a glass antenna 22 provided on a quarter glass pane 16.

The impedance matching circuit 502 is attached onto a surface of the quarter glass pane 14. The impedance matching circuit 504 is attached onto a surface of the quarter glass pane 16. The impedance matching circuits 502, 504 are resonance circuits that have various elements, such as coils, capacitors, and resistors. The impedance matching circuit 502 performs a function of matching the input-side impedance of a branching filter 38 and the feeding point-side impedance of the glass antenna 20. The impedance matching circuit 504 performs a function of matching the input-side impedance of a branching filter 308 and the feeding point-side impedance of the glass antenna 22.

Depending on the transmission distance between an antenna and a shield case, mismatch between the impedance at the side of the antenna and the impedance at the side of an antenna cable connecting the antenna and the shield case becomes likely to occur. Specifically, if the glass antennas 20, 22 receive FM band electromagnetic waves having a wavelength that is about twice the distance (about 2 meters) between the quarter glass panes 14, 16, the electromagnetic waves received by the glass antenna 20 and the electromagnetic waves received by the glass antenna 22 are substantially opposite in phase. If the FM band electromagnetic waves received by the two glass antennas are simply combined in an in-phase manner or an opposite-phase manner, reception sensitivity degradation results.

In this embodiment, the impedance matching circuits 502, 504 are set with appropriate circuit constants such that the resonance point is positioned in a predetermined frequency band. In this structure, the medium-to-high frequency electric powers induced in the glass antennas 20, 22 are supplied to the receiver side after resonance of the electric powers. In this case, with regard to the AM band, the frequency characteristic of reception sensitivity improves, and the transmission loss of the coaxial cables 302, 304, 320 is offset, so that degradation of antenna output reception sensitivity is prevented. With regard to the FM band, the impedance matching between the impedance at the side of the glass antenna 20 and the impedance at the side of the coaxial cable 302, and the impedance matching between the impedance at the side of the glass antenna 22 and the impedance at the side of the coaxial cable 304 are carried out, so that impedance mismatch between the antenna side and the coaxial cable side is eliminated.

Therefore, according to the vehicular antenna device 500 of this embodiment, the antenna outputs of the glass antennas 20, 22 can be supplied to the receiver side without leakage, so that the efficiency of power from the glass antennas 20, 22 to the receiver can be improved, and the reception sensitivity degradation can be prevented. Thus, good reception performance can be secured.

In the fifth embodiment, the impedance matching circuit is formed as the impedance matching circuits 502, 504.

In the third to fifth embodiments, the shield cases 306, 430 containing the combining circuits 44, 50 are disposed near the glass antenna 20 on the quarter glass pane 14 provided in a side surface of the vehicle 12, that is, apart from the glass antenna 22 on the quarter glass pane 16. However, this structure does not restrict the invention. For example, the shield cases may be disposed at a position that is at least 1 m apart from the glass antenna 20 as well. In that case, however, in order to offset the transmission loss of the antenna output, a circuit for amplifying the antenna output is provided near the glass antenna 20. The antenna output amplified by the circuit is supplied to the combining circuits 44, 50 in the shield cases 306, 430.

As is apparent from the foregoing description, according to the invention, noise intrusion and reception sensitivity degradation can be prevented by appropriately combining signals from a plurality of antennas. Therefore, good reception performance can be secured.

Furthermore, according to the invention, degradation in reception performance can be reliably prevented by grounding the outer conductor of a coaxial cable within a shield case.

Still further, according to the invention, good reception performance can be secured in a broad band as a plurality of antennas has individually different frequency characteristics.

Further, according to the invention, antenna output is supplied to a combining circuit after transmission loss is offset by an amplifier circuit. Therefore, reception sensitivity degradation can be prevented, and good reception performance can be reliably delivered.

Further, according to the invention, antenna output loss caused by a branching filter is avoided. Therefore, reception sensitivity degradation can be prevented, and good reception performance can be reliably delivered.

Further, according to the invention, impedance mismatch between the antenna side and the combining circuit side is eliminated. Therefore, reception sensitivity degradation can be prevented, and good reception performance can be reliably delivered.

While the invention has been described with reference to what are presently considered to be preferred embodiments thereof, it is to be understood that the invention is not limited to the disclosed embodiments or structures. On the contrary, the invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the invention.

What is claimed is:

1. A vehicular antenna device, comprising:

a plurality of antennas provided on a vehicle;

a combining circuit that combines signals of the plurality of antennas based on predetermined frequency bands and outputs the combined signals; and at least one shield case grounded to a body of the vehicle, wherein the combining circuit is contained in the at least one shield case.

2. A vehicular antenna device according to claim 1, wherein the plurality of antennas are provided on at least one of a quarter window glass, a windshield, and a rear window.

3. A vehicular antenna device according to claim 1, wherein each of the plurality of antennas has a different received frequency characteristic.

4. A vehicular antenna device, comprising:

a plurality of antennas provided on a vehicle;

a combining circuit that outputs signals of the plurality of antennas, respectively;

at least one shield case grounded to a body of the vehicle, wherein the combining circuit is contained in the at least one shield case; and a branching filter that splits output signals of each of the plurality of antennas, wherein the combining circuit combines the split signals each having a predetermined frequency band, and the branching filter is contained in the shield case.

5. A vehicular antenna device according to claim 4, further comprising an output circuit that amplifies an output signal of the combining circuit, and outputs an amplified signal, wherein the output circuit is contained in the shield case.

6. A vehicular antenna device according to claim 4, wherein each of the plurality of antennas and an input side of the combining circuit are connected via a coaxial cable having an outer conductor grounded to the shield case therein.

7. A vehicular antenna device, comprising:

a plurality of antennas provided on a vehicle;

a combining circuit that outputs signals of the plurality of antennas, respectively;

at least one shield case grounded to a body of the vehicle, wherein the combining circuit is contained in the at least one shield case;

a branching filter that splits output signals of each of the plurality of antennas; and a phase-shift circuit that performs phase adjustment of each of the split signals of a predetermined frequency band, wherein:

the combining circuit combines the split signals each phase-adjusted by the phase-shift circuit and having the predetermined frequency band, and the branching filter and the phase-shift circuit are contained in the shield case.

8. A vehicular antenna device according to claim 7, further comprising an output circuit that amplifies an output signal of the combining circuit, and outputs an amplified signal, wherein the output circuit is contained in the shield case.

9. A vehicular antenna device according to claim 7, wherein each of the plurality of antennas and an input side of the combining circuit are connected via a coaxial cable having an outer conductor grounded to the shield case therein.

10. A vehicular antenna device, comprising:

a plurality of antennas provided on a vehicle;

a combining circuit that outputs signals of the plurality of antennas, respectively;

at least one shield case grounded to a body of the vehicle, wherein the combining circuit is contained in the at least one shield case;

a branching filter that splits output signals of the plurality of antennas into signals of a first frequency band and a second frequency band that is higher than the first frequency band; and a phase-shift circuit that performs phase adjustment of the signals of the second frequency band split by the branching filter, wherein:

the combining circuit includes a first combining circuit that combines the signals of the first frequency band split by the branching filter, and a second combining circuit that combines the signals of the second frequency band that are phase-adjusted by the phase-shift circuit, and the branching filter and the phase-shift circuit are contained in the shield case.

11. A vehicular antenna device according to claim 10, further comprising an output circuit that amplifies an output signal of the combining circuit, and outputs an amplified signal, wherein the output circuit is contained in the shield case.

12. A vehicular antenna device according to claim 10, wherein each of the plurality of antennas and an input side of the combining circuit are connected via a coaxial cable having an outer conductor grounded to the shield case therein.

13. A vehicular antenna device, comprising;

a plurality of antennas provided on a vehicle;

a combining circuit that outputs signals of the plurality of antennas, respectively;

at least one shield case grounded to a body of the vehicle, wherein the combining circuit is contained in the at least one shield case; and an output circuit that amplifies an output signal of the combining circuit, and outputs an amplified signal, wherein the output circuit is contained in the shield case.

14. A vehicular antenna device according to claim 13, wherein each of the plurality of antennas and an input side of the combining circuit are connected via a coaxial cable having an outer conductor grounded to the shield case therein.

15. A vehicular antenna device according to claim 13, wherein the output circuit and a receiver that receives an output signal of the output circuit are connected via a coaxial cable having an outer conductor grounded to the shield case therein.

16. A vehicular antenna device, comprising;

a plurality of antennas provided on a vehicle;

a combining circuit that outputs signals of the plurality of antennas, respectively; and at least one shield case grounded to a body of the vehicle, wherein the combining circuit is contained in the at least one shield case, wherein each of the plurality of antennas and an input side of the combining circuit are connected via a coaxial cable having an outer conductor grounded to the shield case therein.

17. A vehicular antenna device, comprising;

a plurality of antennas provided on a vehicle;

a combining circuit that outputs signals of the plurality of antennas, respectively;

at least one shield case grounded to a body of the vehicle, wherein the combining circuit is contained in the at least one shield case; and an amplifier circuit that is disposed near one of the plurality of antennas having at least a predetermined transmission path distance to the shield case, amplifies an output signal of the antenna, and outputs the amplified signal to the combining circuit.

18. A vehicular antenna device according to claim 17, wherein the amplifier circuit is contained in another shield case separated from the shield case and grounded to the body of the vehicle.

19. A vehicular antenna device, comprising;

a plurality of antennas provided on a vehicle;

a combining circuit that outputs signals of the plurality of antennas, respectively; and at least one shield case grounded to a body of the vehicle, wherein the combining circuit is contained in the at least one shield case, wherein:

the plurality of antennas includes a plurality of first antennas of a first frequency band and a plurality of second antennas of a second frequency band, and the combining circuit includes a first combining circuit that combines output signals of the plurality of first antennas, and a second combining circuit that combines output signals of the plurality of second antennas.

20. A vehicular antenna device, comprising;

a plurality of antennas provided on a vehicle;

a combining circuit that outputs signals of the plurality of antennas, respectively;

at least one shield case grounded to a body of the vehicle, wherein the combining circuit is contained in the at least one shield case; and an impedance matching circuit that is disposed near one of the plurality of antennas having at least a predetermined transmission path distance to the shield case, and that adjusts an impedance near the antenna and an impedance near the combining circuit on the transmission path.

* * * * *